US006748881B1

(12) United States Patent
Heran et al.

(10) Patent No.: US 6,748,881 B1
(45) Date of Patent: Jun. 15, 2004

(54) CONTINUOUS PYROLYSIS FURNACE

(75) Inventors: Robert F. Heran, Westlake, OH (US); Robert A. Koptis, Brook Park, OH (US)

(73) Assignee: Armature Coil Equipment Inc., Cleveland, OH (US)

( * ) Notice: Subject to any disclaimer, the term of this patent is extended or adjusted under 35 U.S.C. 154(b) by 0 days.

(21) Appl. No.: 10/396,162

(22) Filed: Mar. 26, 2003

(51) Int. Cl.[7] ..... F23G 5/00; F23B 5/00; F23N 5/02

(52) U.S. Cl. ..... 110/346; 110/236; 110/246; 110/190; 110/214

(58) Field of Search ..... 110/236, 246, 110/346, 190, 214, 345; 432/112, 118

(56) References Cited

U.S. PATENT DOCUMENTS

| | | | | |
|---|---|---|---|---|
| 3,776,687 A | * | 12/1973 | Heran | 432/6 |
| 4,961,391 A | * | 10/1990 | Mak et al. | 110/346 |
| 4,970,969 A | * | 11/1990 | Koptis et al. | 110/190 |
| 5,657,705 A | * | 8/1997 | Martin et al. | 110/246 |
| 5,965,097 A | * | 10/1999 | Morlec et al. | 423/210 |
| 6,110,430 A | * | 8/2000 | Swisher et al. | 422/173 |
| 6,298,690 B1 | * | 10/2001 | Dahl et al. | 65/28 |
| 6,619,214 B2 | * | 9/2003 | Walker | 110/229 |

* cited by examiner

*Primary Examiner*—Kenneth Rinehart
(74) *Attorney, Agent, or Firm*—John F. McDevitt

(57) ABSTRACT

A pyrolysis furnace is described enabling removal of solid and liquid organic contaminants from various metal parts in a continuous manner. A novel furnace contruction employing a rotating retort vessel is described together with its method of continuous operation.

25 Claims, 3 Drawing Sheets

CONTINUOUS PYROLYSIS FURNACE

BACKGROUND OF THE INVENTION

This invention relates generally to a modified pyrolysis type furnace construction for continuous removal of both solid and liquid organic contaminants from various metal parts and more particularly to having such modified furnace construction doing so in an improved and more effective manner.

In our earlier issued U.S. Pat. No. 4,970,969 there is described a novel batch type pyrolysis furnace for volatilizing and burning organic material from various metal parts which can thereafter be recycled for further use. This furnace apparatus employs a main combustion chamber operating at negative chamber pressure which is heated with an adjustable heating rate burner to directly heat air ducted into said main combustion chamber by convection heat transfer. A supplemental combustion chamber in open communication with said main combustion chamber and vented to the atmosphere contains an auxiliary burner to complete combustion of the volatilized organic contaminants being transported from the main combustion chamber. A single temperature sensing means disposed within said main combustion chamber together with water spray means responsive to said temperature sensing means cooperates with said adjustable heating rate burner to regulate operating temperatures within said main combustion chamber in accordance with a preselected heating schedule. Control of the furnace operation includes programmable temperature control means to maintain continuous operation of said adjustable heating rate burner with (i) a normal full supply of fuel necessary to maintain full combustion in the presence of excess oxygen during a major portion of the pyrolysis cycle, said excess oxygen being relative to the amount required to burn the fuel in said burner, and (ii) a diminished supply of fuel sufficient to maintain fuel-starved combustion during the final portion of the pyrolysis cycle, also in the presence of excess oxygen.

Our co-pending application Ser. No. 10/368,047 entitled "Pyrolysis Furnace Having Improved Heating Efficiency" and filed Feb. 14, 2003 which is also assigned to the present assigned, discloses novel heating means for said batch type pyrolysis furnace construction to provide both convection and radiant heating. The adjustable heating rate burner being employed in said furnace construction includes a tubular extension which combines convection heating with radiant heating during the furnace operation. There is again-further employed the same general type automated temperature control means for such improved furnace operation as was disclosed in our earlier issued patent. The entire contents of said referenced co-pending application are hereby specifically incorporated into the present application.

Batch type reclamation of contaminated metal parts in the foregoing manner has several recognized drawbacks. Material flow must be interrupted during processing in order to load the contaminated parts into the pyrolysis furnace as well as remove already cleaned parts therefrom. Higher labor costs are also attributable to such loading and unloading requirements. Further operator involvement to restart furnace operation with a new batch of the contaminated metal parts contributes to these higher labor costs. Energy costs will also be significantly higher with interrupted furnace operation. Such interrupted furnace operation can further require greater operator involvement for control of the pyrolysis process in order to avoid damaged or unclean metal parts being produced.

As distinct therefrom, continuous furnace operation enables a more effective control of the pyrolysis cycle with lower operating costs. Higher material throughput can be achieved in this manner with minimal operator involvement. Reduced scrap material can also be realized with continuous furnace operation due to much improved control of the pyrolysis cycle being carried out. Start up and cool down periods are thereby eliminated with continuous furnace operation employing conventional equipment means to supply and remove material to the already heated furnace. Thus, a wide variety of contaminated parts can be reclaimed in a continuous manner, including parts contaminated with coatings, lubricants or cutting fluids.

It is an important object of the present invention, therefore, to provide a more effective means to remove organic contaminants from metal parts in a pyrolysis furnace.

It is another important object of the present invention to provide a continuous feed-type pyrolysis furnace adapted for reclamation of contaminated metal parts.

Still another important object of the present invention is to provide a continuous operation pyrolysis furnace incorporating novel structural means for removing organic contaminants from metal parts.

Still another important object of the. present invention is to provide a novel method for continuous removal of organic contaminants from metal parts in a pyrolysis furnace.

These and still further object of the present invention will become more apparent upon considering the following more detailed description of the present invention.

SUMMARY OF THE INVENTION

It has now been discovered, surprisingly, that removal of organic contaminants from metal parts can be carried out more effectively and in a continuous manner when processed in the presently modified furnace apparatus. More particularly, the processing procedure of the present invention employs a pyrolysis furnace having an enclosure physically divided into a main combustion chamber connected to inlet and exhaust chambers, a rotating retort vessel extending thru said enclosure to enable continuous passage of the contaminated metal parts thru said furnace enclosure, an adjustable heating rate burner to directly heat air ducted into said enclosure, and multiple supplemental combustion chambers in open communication with said furnace enclosure and vented to the atmosphere with each containing an auxiliary burner. In said operating procedure, the main combustion chamber is operated with a single temperature sensing means in combination with control means including programmable temperature control means to maintain continuous operation of said adjustable heating rate burner with (i) a normal fuel supply necessary to maintain full combustion of said organic contaminants in the presence of excess oxygen during a major portion of the pyrolysis cycle, said excess oxygen being relative to the amount required to burn the fuel in said burner, and (ii) a diminished supply of fuel sufficient to maintain fuel-starved combustion during the final portion of the pyrolysis cycle, also in the presence of excess oxygen. Water spray means are actuated within said furnace enclosure responsive to said temperature sensing means for operative cooperation with said adjustable heating rate burner to regulate operating temperatures within said furnace enclosure in accordance with a preselected heating schedule. A typical temperature control procedure regulates operating temperature in said furnace enclosure in small incremental stages so as not to exceed a maximum temperature set point. A suitable retort vessel for use in the present furnace construction desirably extends thru said furnace enclosure while being vented to enable exhaust of the volatilized organic contaminants into all divided chambers. Said retort vessel is further provided with inner protuberances, such as flight having a helical configuration, to assist with continuous transport of the contaminated metal parts upon admission to said rotating furnace member. During furnace operation in accordance with the present invention, the main combustion chamber operates at positive chamber pressure whereas both inlet and exhaust chambers in the furnace enclosure are maintained at a negative chamber pressure as are the supplemental combustion chambers in open communication with said furnace enclosure. Pressure sensing means, such as manometers and the like, can also be included in the present furnace construction to monitor desired chamber pressure conditions during furnace operation.

DETAILED DESCRIPTION OF THE PREFERRED EMBODIMENTS

Figure 1:
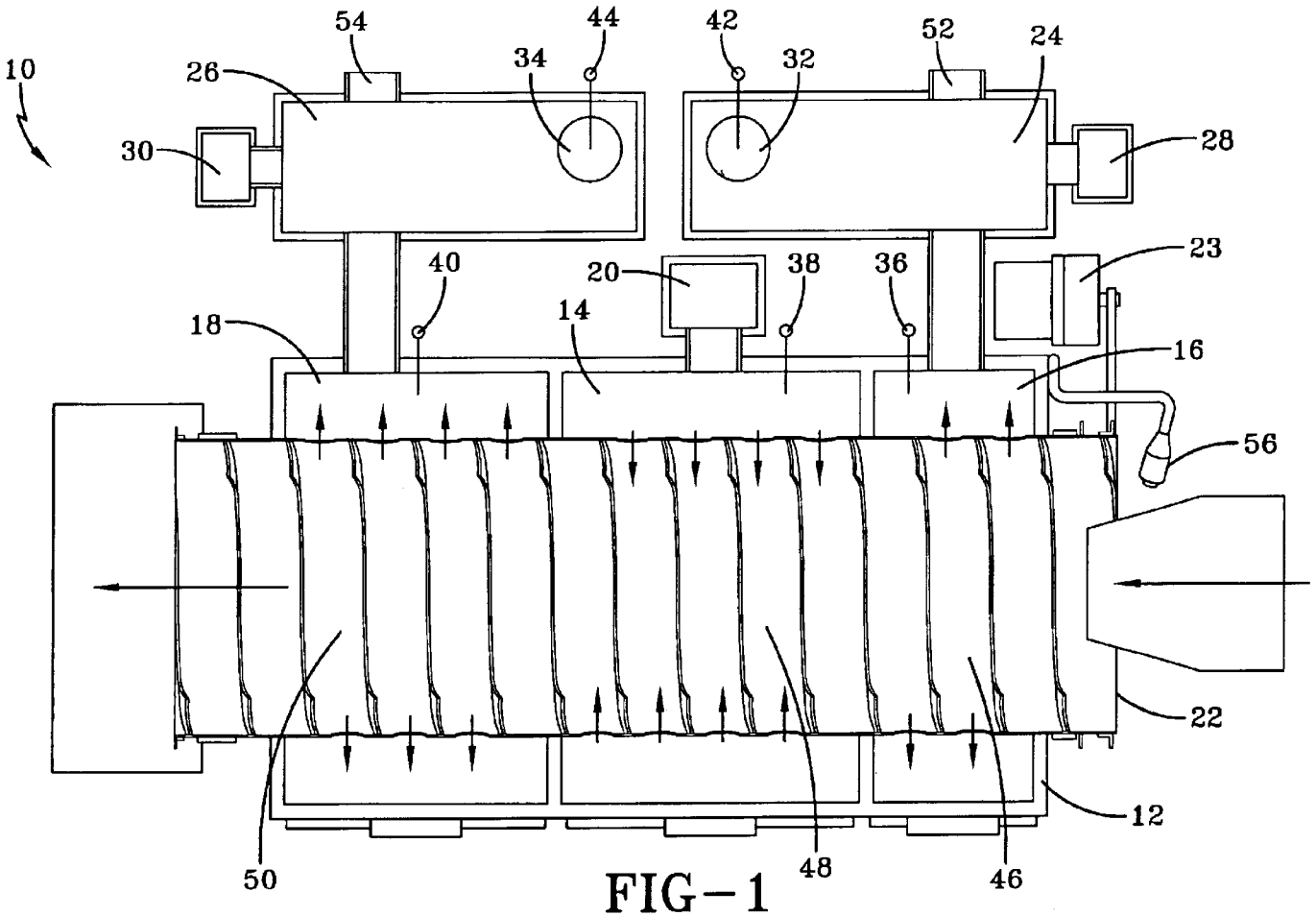
FIG. 1 is a top elevation view of a representative pyrolysis furnace according to the present invention which is controlled by a single temperature sensing means in accordance with a preselected heating schedule.
Figure 2:
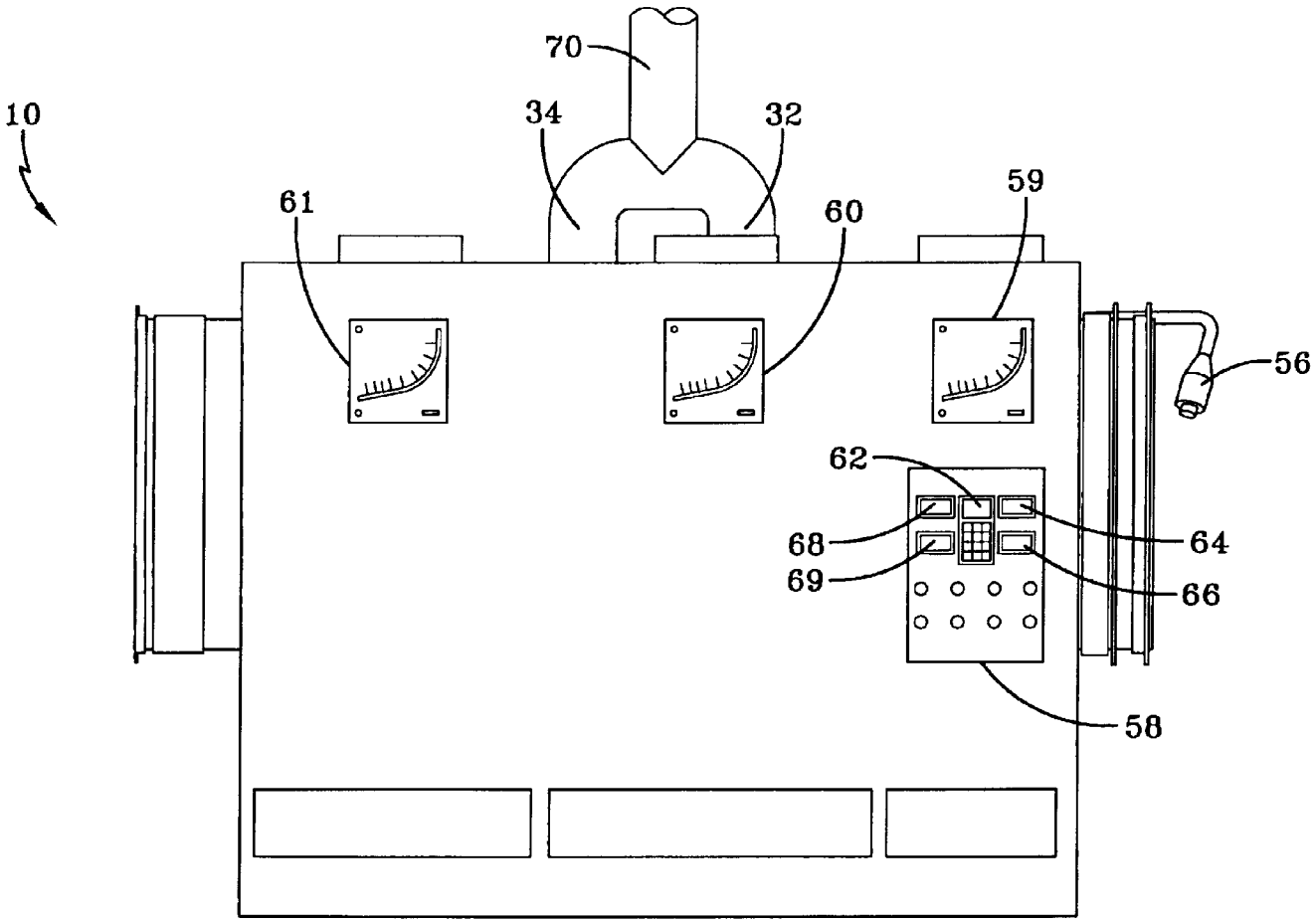
FIG. 2 is a front elevation view depicting the FIG. 1 furnace construction together with the control means being employed to regulate operating temperatures during the continuous pyrolysis process.

Referring to the-drawings, FIGS. 1–2 depict schematically a representative pyrolysis furnace construction which can be employed for complete removal of organic contaminants from various metal parts in a far more effective manner. More particularly, such contaminant removal is carried out in a novel pyrolysis furnace construction whereby the contaminated metal parts are supplied thereto as well as removed therefrom after contaminant removal all in a relatively continuous uninterrupted manner. Said furnace 10 is typically a large enclosed physical structure 12 which can be shaped as a rectangular parallelepiped that is divided into a main combustion chamber 14 connected to an inlet chamber 16 and an exhaust chamber 18. All said divided chambers can be thermally insulated to improve heating efficiency during furnace operation. An adjustable heating rate burner assembly 20 is provided in said main burner chamber to volatilize the organic contaminants in accordance with the presently improved procedure. The gas burner being employed operates either with a normal or "full burner" fuel supply or with a diminished or "fuel-starved" fuel supply during the pyrolysis cycle in a controlled manner to be fully explained hereinafter. The particular adjustable heating rate burner being selected generally depends upon the quantity and composition of the organic contaminants being burned or evaporated as well as the physical size of the retort vessel member 22 extending thru all divided chambers in said furnace enclosure. For example, a typical retort vessel having a hollow cylindrical shape with a 36 inch inside diameter and 120 inches length which is being employed to reclaim 500 pounds of metal having 25 weight percent polymer contamination can employ a Midco Incinomite burner rated up to 800,000 BTU/hr output. A suitable retort vessel of this type can be fabricated with various heat resistant materials, such as stainless steel. Said type retort vessel construction is more fully described in accompanying FIG. 3. Drive motor 23 continuously rotates said retort vessel during furnace operation.

There is further provided in the present furnace embodiment a pair of supplemental combustion chambers 24 and 26 in open communication with said furnace enclosure and which each includes an auxiliary burner means 28 and 30, respectively, to complete combustion of the volatilized organic contaminants being transported from the furnace enclosure. Said auxiliary combustion chambers include openings 32 and 34, respectively, which are vented to the atmosphere for exhaust via a common stack (see FIG. 2). Multiple temperature sensing means 36, 38 and 40 are disposed within the divided chambers of the furnace enclosure in order to monitor as well as control the continuous furnace operation. Additional temperature sensing means 42 and 44 are also disposed in auxiliary combustion chambers 24 and 26, respectively, to insure complete combustion of the volatilized organic contaminants as a non-visible smoke before venting to the atmosphere. The successive heating zones 46, 48 and 50 within said retort vessel 22 are further provided with openings (see FIG. 3) enabling escape of the organic contaminants being volatilized thereat to an adjoining divided chamber in said furnace enclosure. Passage ducts 52 and 54 in the respective supplemental combustion chambers 24 and 26 allow inlet air to said chambers for complete combustion of the volatilized organic contaminants thereat. Water spray means 56 enables cooling moisture to be admitted to retort vessel 22 when actuated in accordance with the present operating procedure.

Control means for operation of said presently illustrated furnace embodiment are depicted in FIG. 2. A front external view of the FIG. 1 furnace construction 10 is shown having an electrical control panel 58 mounted thereat together with multiple manometer pressure sensing instruments 59, 60 and 61. The latter devices monitor chamber pressure in the respective divided chambers 14, 16 and 18 of said furnace enclosure. In accordance with the present operating procedure, a positive chamber pressure is maintained in main combustion chamber 14 while negative chamber pressure is maintained in both inlet and exhaust chambers during furnace operation. The latter chamber operating pressures enable the volatilized organic contaminants to be drawn into both supplemental combustion chambers 24 and 26 for complete combustion therein. Control panel 58 includes programmable temperature control means 62 to maintain continuous operation of said adjustable heating rate burner 20 throughout the entire pyrolysis cycle with (i) a normal full supply of fuel necessary to maintain full combustion of the organic contaminants present in the metal parts being continuously transported within retort vessel 22 in the presence of excess oxygen during a major portion of the pyrolysis cycle, said excess oxygen being relative to the amount required to burn the fuel in said burner, and (ii) a diminished supply of fuel sufficient to maintain fuel-starved combustion during the final portion of the pyrolysis cycle, also in the presence of excess oxygen. Said manner of continuous operation employs the temperature sensing device 38 disposed in main combustion chamber 14 for the transmission of control signals to said programmable temperature control means 62 mounted on electrical panel 58 in the furnace operation. Operation of said programmable temperature control means proceeds in the same general manner more fully explained in our aforementioned previously issued United States Patent. Accordingly, operating temperatures being maintained in the illustrated furnace embodiment can be controlled so as not to exceed a preselected maximum operating temperature while also being regulated in small incremental stages. Readout displays 64, 66, 68 and 69 on control panel 58 simply monitor the operating temperatures being sensed in the divided combustion chambers of the illustrated furnace embodiment. A common vent stack 70 enabling discharge to the atmosphere of combustion products from supplemental combustion chambers 24 and 26 is also depicted in the present drawing.

Figure 3:
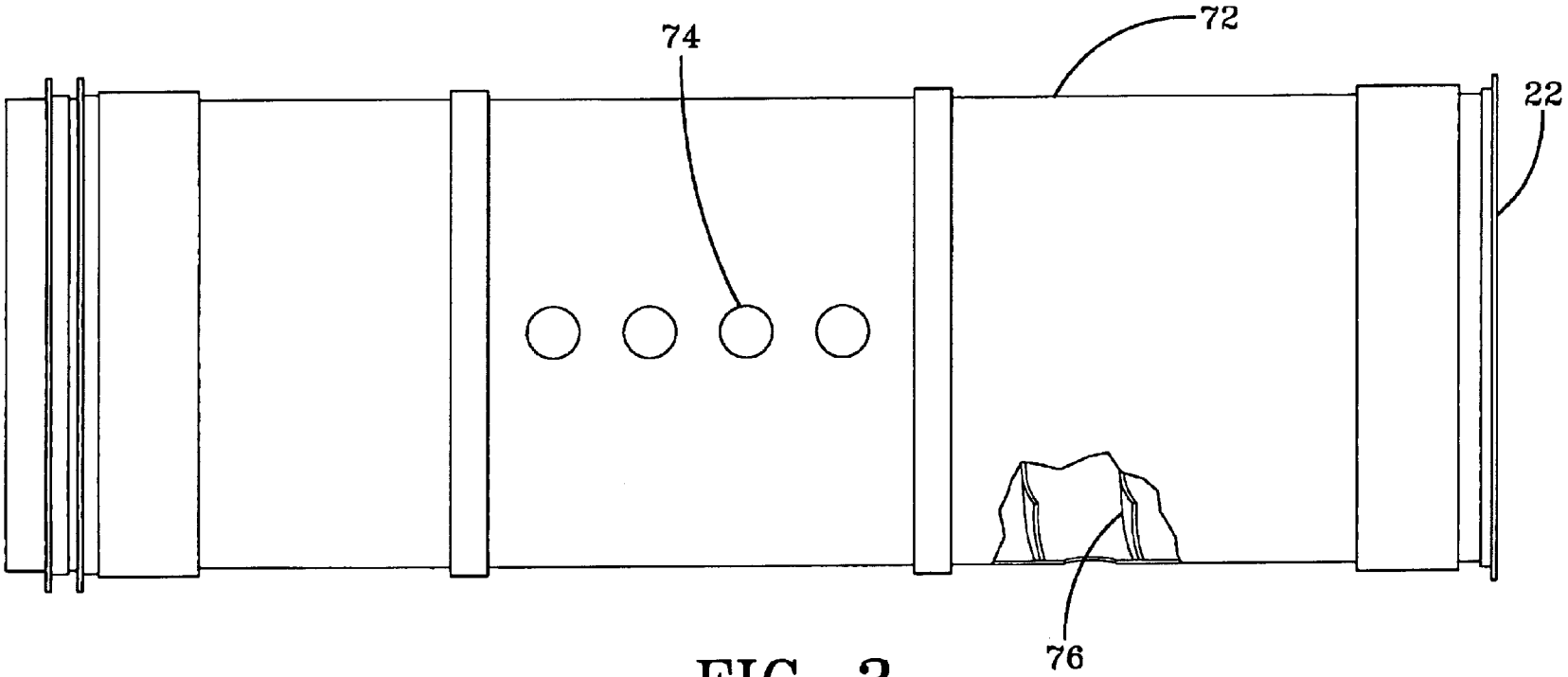
FIG. 3 is a side elevation view for the rotating retort vessel being employed in the FIG. 1 furnace construction.

In FIG. 3 a side elevation view of the rotating retort vessel 22 being employed in the FIG. 1 furnace embodiment is depicted. Said hollow cylindrical member 72 includes multiple openings 74 along its entire length for passage of volatilized organic contaminants to the surrounding divided combustion chambers 14, 16 and 18 in said furnace apparatus. Multiple protuberances 76 are also provided on the inner wall of said cylindrical member to facilitate a continuous passage of the contaminated metal parts being reclaimed throughout the entire length of said cylindrical retort vessel when being continuously rotated. As can be observed, said multiple internal protuberances have a helical configuration which can further include baffle elements (not shown) to assist with the material transport. Also not shown in the present drawings is the conventional equipment means employed to continuously supply the contaminated metal parts to the depicted retort vessel.

It will be apparent from the foregoing description that a broadly useful and novel means to continuously reclaim metal parts contaminated with various solid and liquid coatings has been provided. It is also contemplated that already known modifications can be made in the disclosed furnace apparatus and method for its operation without departing from the present invention. For example, the employment of additional burners in the disclosed apparatus can be permitted although complicating the control procedure associated with having such multiple heat sources. Likewise, multiple water sprays can be employed to further control the present combustion process from overheating. Accordingly, it is intended to cover all variations of the present improvements which may be devised by persons skilled in the art as falling within the true spirit and scope of the herein claimed invention.

What we claim and desire to secure by Letters Patent of the United States is:

1. A continuous method to remove organic contaminants from metal parts in a pyrolysis furnace having an enclosure physically divided into a main combustion chamber connected to inlet and exhaust chambers, a rotating retort vessel extending thru said enclosure to enable continuous passage of contaminated metal parts thru said pyrolysis furnace, an adjustable heating rate burner to directly heat air ducted into said enclosure, and multiple supplemental combustion chambers in open communication with said furnace enclosure and vented to the atmosphere with each containing an auxiliary burner, said method comprising:

(a) operating said main combustion chamber at a positive chamber pressure while concurrently operating both inlet and exhaust chambers at a negative chamber pressure, said operation being conducted with temperature sensing means in combination with control means including programmable temperature control means to maintain continuous operation of said adjustable heating rate burner with (i) a normal fuel supply necessary to maintain full combustion of said organic contaminants in the presence of excess oxygen during a major portion of the pyrolysis cycle, said excess oxygen being relative to the amount required to burn the fuel in said burner, and (ii) a diminished supply of fuel sufficient to maintain fuel-starved combustion during the final portion of the pyrolysis, also in the presence of excess oxygen, (b) activating a water spray within said furnace enclosure responsive to said temperature sensing means for operative cooperation with said adjustable heating rate burner to regulate operating temperatures within said furnace enclosure in accordance with a preselected heating schedule, (c) employing multiple auxiliary burners to complete combustion of the volatized organic contaminants being transported from said furnace enclosure within said supplemental combustion chambers, and (d) continuously supplying said contaminated metal parts to the retort vessel in said pyrolysis furnace.

2. The method of claim 1 wherein said supplemental combustion chambers are operated at negative chamber pressure.

3. The method of claim 1 wherein chamber pressure is monitored with manometer means.

4. The method of claim 1 wherein volatilized organic contaminants from the retort vessel are exhausted directly to the divided chamber in said furnace enclosure.

5. The method of claim 1 wherein the furnace control means regulates the supply of contaminant metal parts to the retort vessel so as not to exceed a preselected maximum operating temperature.

6. The method of claim 1 wherein said furnace control means raises the operating temperature in said furnace enclosure in incremental stages.

7. The method of claim 1 wherein operation of said adjustable heating rate burner is terminated upon completion of the pyrolysis cycle.

8. The method of claim 1 wherein said water spray is actuated upon exceeding a preselected operating temperature in said furnace enclosure.

9. The method of claim 1 wherein no visible smoke emerges from the supplemental combustion chambers.

10. A continuous type pyrolysis furnace having:

(a) an enclosure physically divided into a main combustion chamber connected to inlet and exhaust chambers, said main combustion chamber operating at positive chamber pressure whereas both inlet and exhaust chambers operating at negative chamber pressure, (b) an adjustable heating rate burner to directly heat air ducted into said enclosure, (c) a rotating retort vessel extending thru said enclosure to enable continuous passage of metal parts contaminated with various organic materials thru said pyrolysis furnace, (d) multiple supplemental combustion chambers in open communication with said enclosure and vented to the atmosphere with each containing an auxiliary burner, (e) temperature sensing means disposed within said enclosure, (f) water spray means responsive to said temperature sensing means for operative cooperation with said adjustable heating rate burner to regulate operating temperatures within said enclosure in accordance with a preselected heating schedule, (g) control means including programmable temperature control means to maintain continuous operation of said adjustable heating rate burner with (i) a normal full supply of fuel necessary to maintain full combustion with presence of excess oxygen during a major portion of the pyrolysis cycle, said excess of oxygen being relative to the amount required to burn the fuel in said burner, and (ii) a diminished supply of fuel sufficient to maintain fuel-starved combustion during the final portion of the pyrolysis cycle, also in the presence of excess oxygen, and (h) supply means continuously transporting said contaminated metal parts to the retort vessel in said pyrolysis furnace.

11. The pyrolysis furnace of claim 10 wherein said adjustable heating rate burner is disposed within the main combustion chamber of said furnace enclosure.

12. The pyrolysis furnace of claim 10 wherein temperature sensing means disposed within said main combustion chamber regulates operating temperatures within said enclosure.

13. The pyrolysis furnace of claim 12 wherein auxiliary temperature sensing means are also disposed in the inlet and exhaust chambers of said enclosure.

14. The pyrolysis furnace of claim 13 wherein auxiliary temperature sensing means are also disposed in the supplemental combustion chambers of said pyrolysis furnace.

15. The pyrolysis furnace of claim 10 wherein said supplemental combustion chambers are operated at negative chamber pressure.

16. The pyrolysis furnace of claim 10 wherein auxiliary burners disposed in said supplemental combustion chambers provide complete combustion of the volatilized organic contaminates being transported from said furnace enclosure.

17. The pyrolysis furnace of claim 16 wherein said supplemental combustion chambers exhaust thru a common vent stack to the atmosphere.

18. The pyrolysis furnace of claim 10 wherein chamber pressure is monitored by manometer means.

19. The pyrolysis furnace of claim 10 wherein the furnace control means regulates the supply of contaminated metal parts to the retort vessel so as not to exceed a preselected maximum operating temperature.

20. The pyrolysis furnace of claim 10 wherein the retort vessel includes openings enabling exhaust of the volatilized organic contaminants directly to the divided chambers in the furnace enclosure.

21. The pyrolysis furnace of claim 20 wherein the volatilized organic contaminants are exhausted to all divided chambers.

22. The pyrolysis furnace of claim 10 wherein the retort vessel includes inner protuberances assisting continuous passage of the contaminated metal parts during vessel rotation.

23. The pyrolysis furnace of claim 22 wherein said inner protuberances have a helical configuration.

24. The pyrolysis furnace of claim 23 wherein said helical protuberances includes baffle elements to mix contaminated metal parts.

25. The pyrolysis furnace of claim 22 wherein said retort vessel also includes openings enabling exhaust of the volatilized organic contaminants directly to the divided chambers in the furnace enclosure.

* * * * *